US010797403B2

(12) United States Patent
Adams et al.

(10) Patent No.: US 10,797,403 B2
(45) Date of Patent: Oct. 6, 2020

(54) DUAL ULTRA WIDE BAND CONFORMAL ELECTRONICALLY SCANNING ANTENNA LINEAR ARRAY

(71) Applicant: The Boeing Company, Chicago, IL (US)

(72) Inventors: Alec Adams, Seattle, WA (US); Ming Chen, Bellevue, WA (US); Lixin Cai, Ravensdale, WA (US)

(73) Assignee: THE BOEING COMPANY, Chicago, IL (US)

( * ) Notice: Subject to any disclaimer, the term of this patent is extended or adjusted under 35 U.S.C. 154(b) by 246 days.

(21) Appl. No.: 15/963,812

(22) Filed: Apr. 26, 2018

(65) Prior Publication Data

US 2019/0334252 A1 Oct. 31, 2019

(51) Int. Cl.

| | |
|---|---|
| ***H01Q 21/10*** | (2006.01) |
| ***H01Q 21/06*** | (2006.01) |
| ***H01Q 5/314*** | (2015.01) |
| ***H01Q 5/48*** | (2015.01) |
| ***H01Q 5/25*** | (2015.01) |
| ***H01Q 9/20*** | (2006.01) |
| ***H01Q 9/16*** | (2006.01) |
| ***H01Q 9/06*** | (2006.01) |
| ***H01Q 19/10*** | (2006.01) |
| *H01Q 9/28* | (2006.01) |

(52) U.S. Cl.

CPC ..... *H01Q 21/062* (2013.01); *H01Q 5/25* (2015.01); *H01Q 5/314* (2015.01); *H01Q 5/48* (2015.01); *H01Q 9/065* (2013.01); *H01Q 9/16* (2013.01); *H01Q 9/20* (2013.01); *H01Q 19/108* (2013.01); *H01Q 9/285* (2013.01)

(58) Field of Classification Search

CPC ..... H01Q 5/48; H01Q 9/16; H01Q 19/108; H01Q 21/062

See application file for complete search history.

(56) References Cited

U.S. PATENT DOCUMENTS

| | | | | |
|---|---|---|---|---|
| 6,448,937 | B1 * | 9/2002 | Aiken | H01Q 21/062 343/817 |
| 6,512,487 | B1 * | 1/2003 | Taylor | H01Q 9/285 343/795 |
| 7,463,210 | B2 * | 12/2008 | Rawnick | H01Q 9/285 343/795 |

(Continued)

OTHER PUBLICATIONS

Magill, E.G., et al., "Wide-Angle Impedance Matching of a Planar Array Antenna by a Dielectric Sheet", IEEE Transactions on Antennas and Propagation, Jan. 1966, pp. 49-53, vol. AP-14, No. 1.

*Primary Examiner* — Ab Salam Alkassim, Jr.

(74) *Attorney, Agent, or Firm* — Gates & Cooper LLP

(57) ABSTRACT

A dual ultra-wideband electronically scanning antenna linear array and a method for producing same is disclosed. In one embodiment, the antenna is comprised of circuit board-based multi-layered sections with integrated feeds. A first dielectric layer or substrate has a thin metal coating on the bottom surface to form a signal ground and metal coating on the top surface where capacitively loaded radiating dipoles are etched. Each of the dipole elements are connected to an associated conductive antenna feed disposed on a bottom surface of another dielectric layer disposed below the first dielectric layer.

20 Claims, 8 Drawing Sheets

(56) References Cited

U.S. PATENT DOCUMENTS

| | | | | |
|---|---|---|---|---|
| 8,325,093 | B2 * | 12/2012 | Holland | H01P 5/10 343/700 MS |
| 9,000,996 | B2 * | 4/2015 | Holland | H01Q 9/28 343/700 MS |
| 9,172,147 | B1 * | 10/2015 | Manry, Jr. | H01Q 1/286 |
| 10,027,030 | B2 * | 7/2018 | Boryssenko | H01Q 21/26 |
| 2004/0017325 | A1 * | 1/2004 | Satoh | H01Q 1/38 343/795 |
| 2007/0222696 | A1 * | 9/2007 | Wikstrom | H01Q 21/067 343/797 |
| 2008/0174503 | A1 * | 7/2008 | Kim | H01Q 9/0407 343/722 |
| 2010/0007572 | A1 * | 1/2010 | Jones | H01Q 9/28 343/798 |
| 2011/0057852 | A1 * | 3/2011 | Holland | H01Q 9/28 343/795 |
| 2012/0146869 | A1 * | 6/2012 | Holland | H01P 5/10 343/795 |
| 2013/0069840 | A1 * | 3/2013 | Lewis | H01Q 9/0407 343/798 |
| 2015/0162665 | A1 * | 6/2015 | Boryssenko | H01Q 1/48 343/797 |
| 2017/0025767 | A1 * | 1/2017 | Elsallal | H01Q 3/30 |
| 2018/0040955 | A1 * | 2/2018 | Vouvakis | H01Q 9/285 |
| 2018/0337461 | A1 * | 11/2018 | Kildal | H01Q 9/28 |
| 2019/0089068 | A1 * | 3/2019 | Franzini | H01Q 3/34 |
| 2020/0028277 | A1 * | 1/2020 | Watson | H01Q 21/29 |

* cited by examiner

DUAL ULTRA WIDE BAND CONFORMAL ELECTRONICALLY SCANNING ANTENNA LINEAR ARRAY

BACKGROUND

1. Field

The present disclosure relates to antennas and method for fabricating same, and in particular to a wideband conformal electronically scanning antenna linear array.

2. Description of the Related Art

Electronically scanned antennas can be used in a wide variety of applications. In some applications, it is useful to place the antenna on an outer surface so that the surface of the antenna is conformal with the surfaces of the structures upon which it is mounted. For example, an antenna array may be mounted on the external skin of an airplane, a missile or ordnance such as a shell.

While such applications are useful, they often require both the ability to operate over wide bands and to scan at large angles from array broadside. For example, an antenna conformally mounted to the foreportion of the surface of a shell needs to be scanned to a large angle from local surface normal, so that the beam peak or sensitive axis of the antenna is in the direction the shell is traveling. Such applications also are typically space constrained, so that there is insufficient room to place a multi-dimensional array of antenna elements.

What is needed is an antenna that provides ultra wide band operation, can be mounted conformally to a wide variety of potentially complex surfaces within small areas, and can be scanned to large angles. What is also needed is a method for producing such an antenna. This disclosure describes an antenna satisfying these needs.

SUMMARY

To address the requirements described above, this document discloses an antenna and a method for producing same. One embodiment is evidenced by an antenna, comprising: a first dielectric layer, having a first dielectric layer first side and a first dielectric layer second side including a conductive ground plane; a second dielectric layer, having a second dielectric layer first side disposed adjacent the first dielectric layer second side and a second dielectric layer second side; a plurality of antenna elements, disposed along a first axis, where each of the plurality of antenna elements are separated by a distance along the first axis. Each of the plurality of antenna elements comprises: a first dipole element formed on the first dielectric layer first side along a second axis perpendicular to the first axis, the first dipole element having a first dipole element first end a first dipole element second end having a capacitively loaded first stub; a second dipole element formed on the first dielectric layer first side along the second axis and colinear with the first dipole, the second dipole element having a second dipole element first end proximate the first dipole element first end and a second dipole element second end distal from the first dipole element first end having a capacitively loaded second stub. Each of the second dipole element first ends are connected to an associated conductive antenna feed disposed on the second dielectric layer second side. In one embodiment, the plurality of antenna elements are disposed in only one row along the first axis. In one embodiment, the antenna further comprises a dielectric superstrate disposed on the first dielectric layer first side.

Another embodiment is evidenced by a method of producing an antenna, comprising: producing a first dielectric layer, having a first dielectric layer first side and a first dielectric layer second side including a conductive ground plane; producing a second dielectric layer, having a second dielectric layer first side disposed adjacent the first dielectric layer second side and a second dielectric layer second side; forming a plurality of antenna elements, disposed along a first axis, where each of the plurality of antenna elements are separated by a distance along the first axis, and shorting the second dipole element first end of each of the antenna elements to an associated conductive antenna feed disposed on the second dielectric layer second side. Each of the plurality of antenna elements comprises: a first dipole element formed on the first dielectric layer first side along a second axis perpendicular to the first axis, the first dipole element having a first dipole element first end a first dipole element second end having a capacitively loaded first stub; a second dipole element formed on the first dielectric layer first side along the second axis and colinear with the first dipole, the second dipole element having a second dipole element first end proximate the first dipole element first end and a second dipole element second end distal from the first dipole element first end having a capacitively loaded second stub. A further embodiment is evidenced by an antenna produced by the foregoing method steps.

The features, functions, and advantages that have been discussed can be achieved independently in various embodiments of the present invention or may be combined in yet other embodiments, further details of which can be seen with reference to the following description and drawings.

BRIEF DESCRIPTION OF THE DRAWINGS

Referring now to the drawings in which like reference numbers represent corresponding parts throughout.

DESCRIPTION

Figure 1:
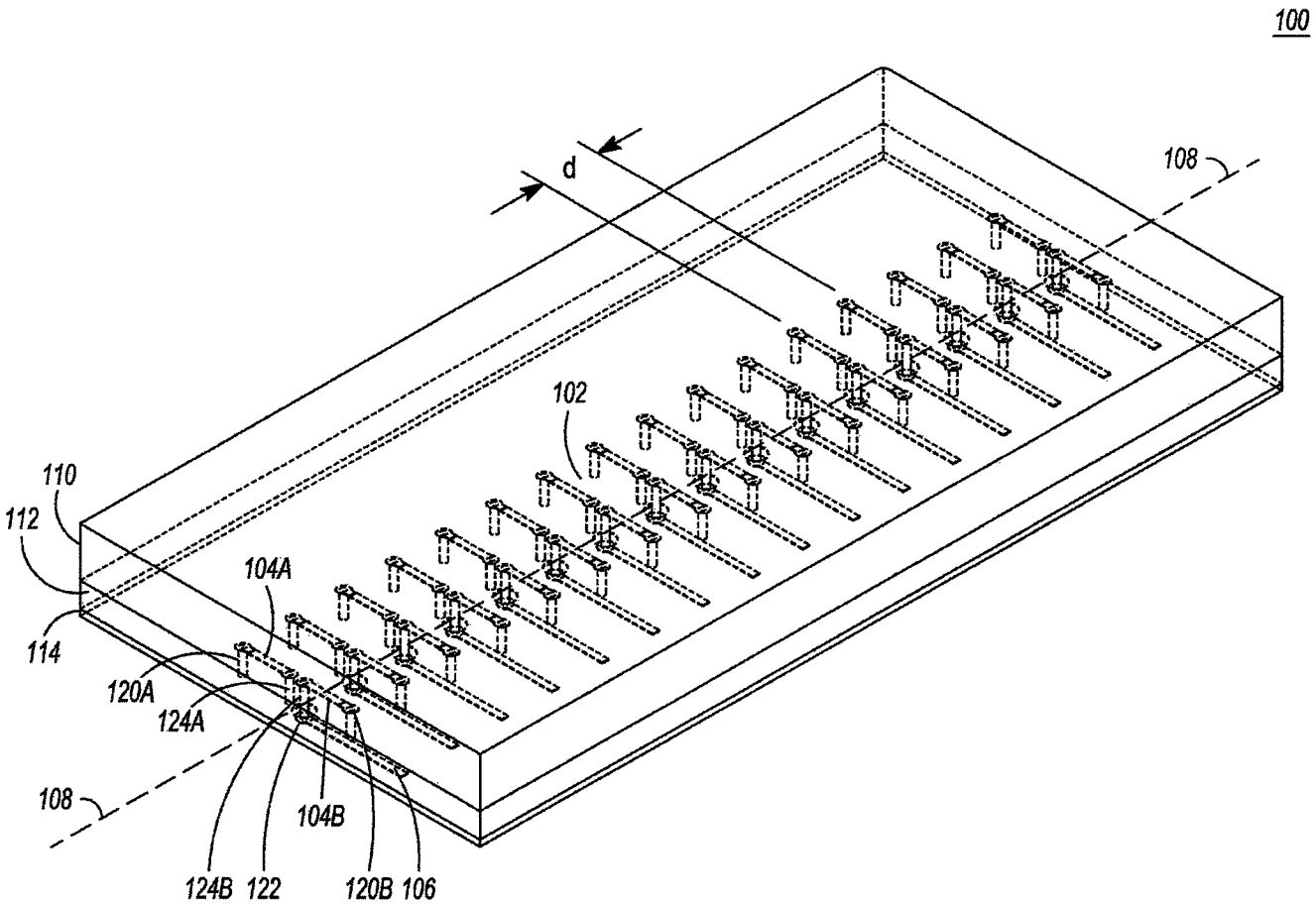
FIG. 1 is a diagram illustrating a three dimensional (3D) view of one embodiment of the antenna.

In the following description, reference is made to the accompanying drawings which form a part hereof, and which is shown, by way of illustration, several embodiments. It is understood that other embodiments may be utilized and structural changes may be made without departing from the scope of the present disclosure.

Overview

A dual ultra-wideband electronically scanning antenna linear array is disclosed below. The antenna comprises a plurality of circuit board-based multi-layered sections with integrated feeds. The top layer is a dielectric superstrate which improves overall scan performance and also serves as an environmental shield against corrosion. The second dielectric layer or substrate has a thin metal coating on the bottom surface to form a signal ground and metal coating on the top surface where capacitively loaded radiating dipoles are placed, for example, by etching. High-fidelity simulations show that the antenna has good RF performance over ultra-wide bandwidth of more than 25% in the Ka and Ku bands over wide scan, the ability to scan to 90 degrees from array broadside without the onset of grating lobes. The array performs as a single polarization array near boresight and as a dual switchable polarization array at lager scan angles. This antenna array can be made conformal by forming it into the outer mold line of the outer skin of a vehicle.

This antenna array provides a means to send (or receive) RF signals from (or to) airborne/mobile vehicles with an agile switchable dual ultra-wide-band electronically scanning antenna linear array fan beam without mechanical moving parts. The antenna array can be used in radar/sensor/seeker systems and other applications including communications and Electronic Warfare (EW), thus providing a high-performance, light-weight, low-profile and affordable solution to meet challenging and evolving mission requirements.

One previous solution used relatively bulky and narrow-band waveguides of circular cross-section to form the aperture of an electronically scanning antenna array system. However, such existing solutions do not meet size, weights, or scan angle requirements. Another existing solution uses a planar patch array mounted inside a lengthy nose radome. This solution does not meet bandwidth, angular coverage or air vehicle surface-conformity requirements.

This design improves the operating bandwidth of legacy electronically scanning antenna array over existing solutions and allows for multiband operation. Other potential solutions cannot be made conformal with the vehicles surface. The design also allows for end fire operation, increase the scan angle from array broadside out to 90 degrees far beyond the existing arrays which typically scan out to 60 degrees. The antenna array performs as a single polarization array near boresight and as a dual switchable polarization array at lager scan angles. In addition, this invention uses low-cost, light-weight and low-profile circuit board-based sections to reduce antenna array weight and thickness substantially compared to some existing solutions.

FIG. 1 is a diagram illustrating a 3D view of one embodiment of the antenna 100. In the illustrated embodiment the antenna 100 comprises an antenna linear array formed by multiple unit cells positioned along an array axis 108. As a linear array 102, electronic beam scan is only possible on a plane orthogonal to the array surface plane and parallel to the array axis along which the unit cells of dipole antennas 104 are positioned. The top layer 110 is a dielectric superstrate which improves overall scan performance and also serves as an environmental shield against corrosion. The first dielectric layer or substrate 112 has a thin metal coating on the bottom surface to form a signal ground and metal coating on the top surface where dipoles 104A and 104B for each unit cell are disposed with capacitively loaded stubs 218A and 218B shorted to ground at 226A and 228B are etched. For each dipole 104, one arm 105A is grounded by a metallic via 124A through the substrate or first dielectric layer 112 and the other arm 105B is connected to a feedline 106 by another via 124B to location 226B. This type of structure provides an economical and effective way to feed the antenna over 2:1 bandwidth or more without the use of more bulky and complicated ultra-wideband balun. The finite ground plane size shown in FIG. 1 may be varied to better fit the external shape of a structure to which it is mounted. It may also be curved to become conformal to the external shape of the structure.

The ground reactance and capacitively loaded stub reactance of the radiating dipole 104 are tuned to partially cancel each other, leading to a stable and well-behaved active impedance match over required wide bandwidth and large scan coverage.

Figure 2:
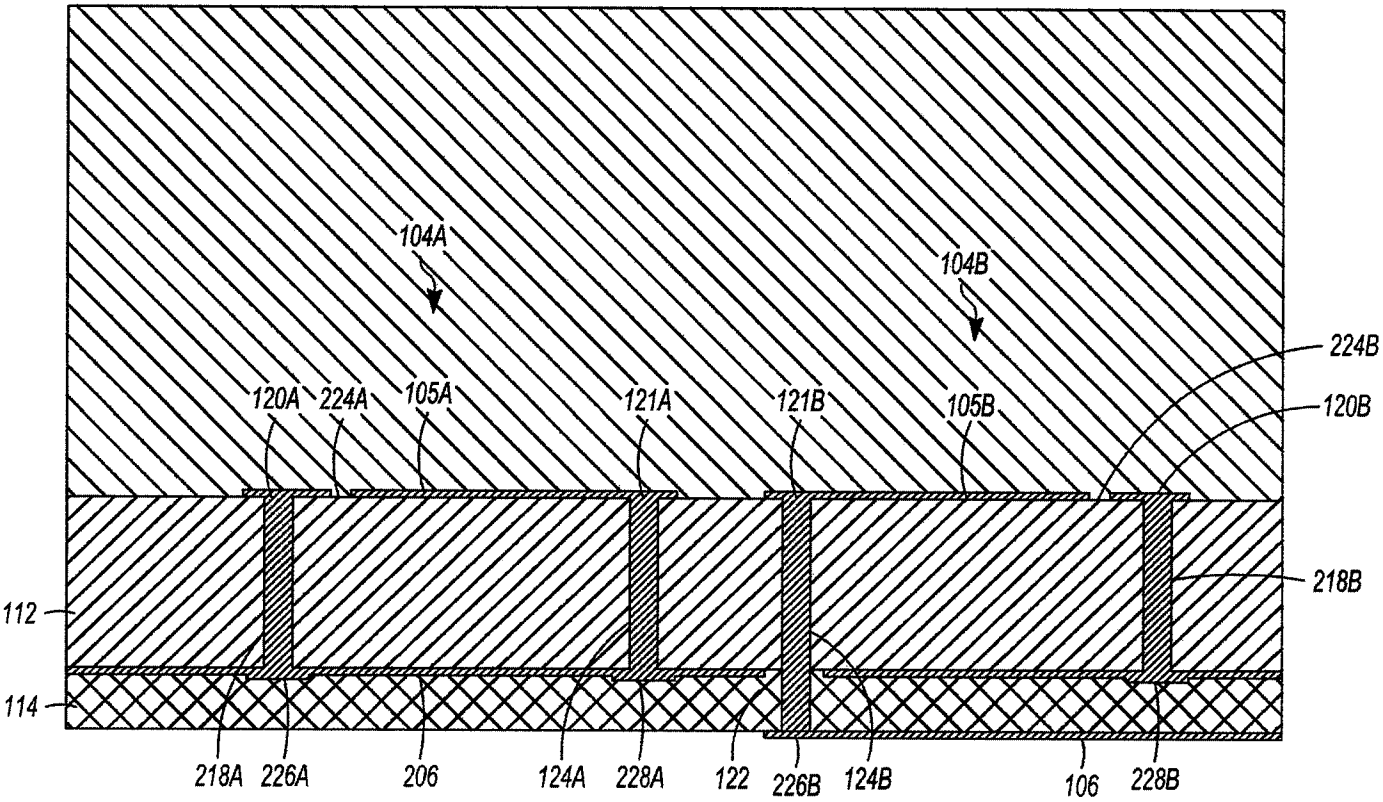
FIG. 2 is a diagram showing cutaway view of the antenna along an axis.

FIG. 2 is a diagram showing cutaway view of the antenna 100 along axis 108. As illustrated, the antenna 100 comprises a first dielectric layer 112, having a first dielectric layer first side (top of dielectric layer 112) and a first dielectric layer second side (bottom of dielectric layer 112) that includes a conductive ground plane 206. The antenna 100 also comprises a second dielectric layer 114, having a second dielectric layer first side (top of dielectric layer 114) disposed adjacent the first dielectric layer second side and a second dielectric layer second side (bottom of dielectric layer 114).

The antenna 100 also comprises a plurality of antenna elements 104, disposed along a first axis 108. Each of the plurality of antenna elements 104 are separated by a distance d along the first axis 108. Further, each of the plurality of antenna elements 104 comprises a first dipole element 104A and a second dipole element 104B.

The first dipole element 104A is formed on the first dielectric layer first side along a second axis perpendicular to the first axis 108 and in the plane of the antenna 100, and the first dipole element 104A has a first dipole element first end 120A and a first dipole element second end 121A having a capacitively loaded first stub 218A. Similarly, the second dipole element 104B is formed on the first dielectric layer first side along the second axis and colinear with the first dipole 104A. The second dipole element 104B has a second dipole element first end 121B proximate the first dipole element second end 124A and a second dipole element second end 120B distal from the second dipole element first end 121B having a capacitively loaded second stub 218B.

Finally, as illustrated second dipole element first end 121B is connected to an associated conductive antenna feed 106 disposed on the second dielectric layer second side. Further, in the illustrated embodiment, the plurality of antenna elements 104 are disposed in only one row along the first axis 108. Having only a single row (making the array a 1×N element array) allows the antenna to be disposed in relatively small places, while allowing scanning in the plane defined by the row.

In one embodiment, the capacitive loaded first stub 218A is formed by a first gap 224A between the first dipole element first end 120A and the first dipole element second end 121A, with the first dipole element second end 121A shorted to the conductive ground plane 206 at location 228A. Further, in this embodiment, the capacitive loaded second stub 218B is formed by a second gap 224B between the second dipole element first end 121B and the second dipole element second end 120B, and the second dipole element second end 120B is shorted to the conductive ground plane 206 at location 228B.

In yet another embodiment, the second dipole element first end 121B is connected to the conductive antenna feed 106 disposed on the second dielectric layer second side through a non-conductive aperture 122 in the conductive ground plane 206.

As disclosed above, the antenna 100 comprises a dielectric superstrate 110 disposed on the first (top) side of the first dielectric layer 112. This dielectric superstrate layer 110 protects the conductive elements disposed on the first side of the first dielectric layer 112.

In yet another embodiment, the dielectric superstrate 110 is configured to be conformal with the outer surface of the structure to which it is attached, such as a vehicle.

In still another embodiment, the plurality of antenna elements are separated by a distance d substantially equal to a ¼ free space wavelength of the highest frequency transmitted or received by the antenna element 104.

Figure 3:
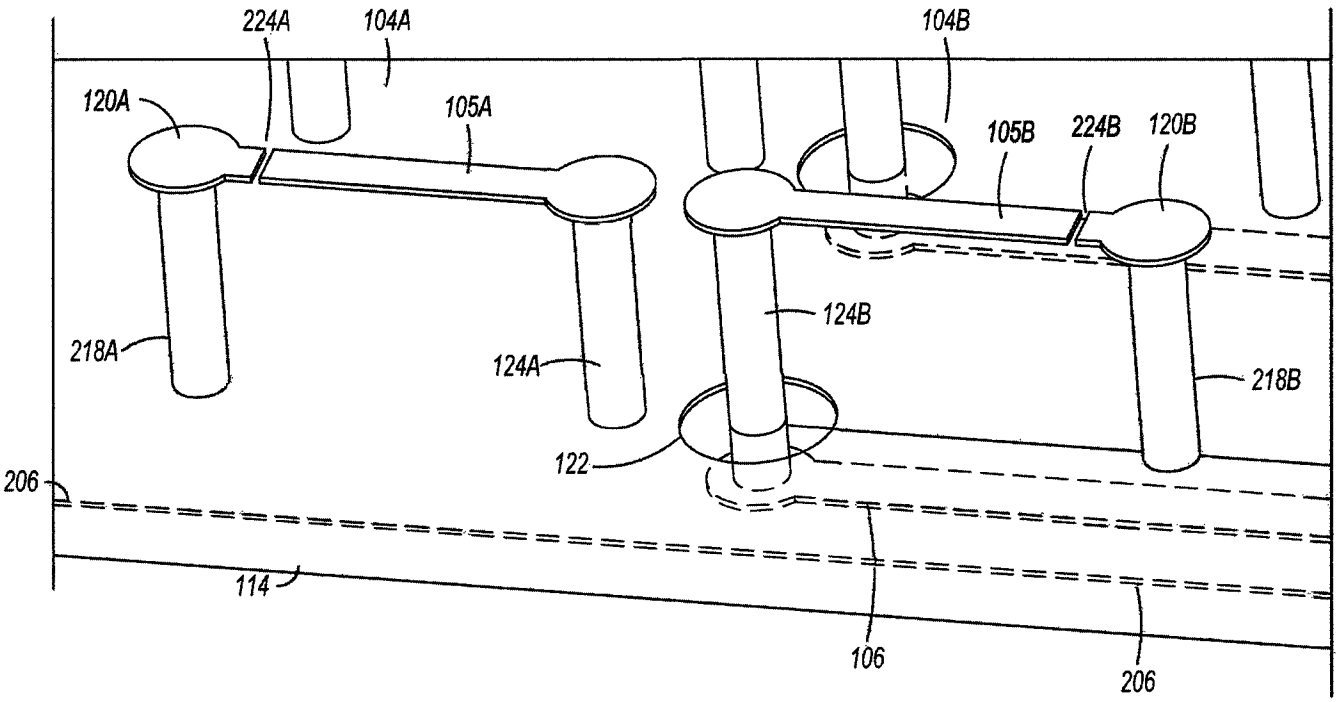
FIG. 3 is a diagram presenting a 3D view of one of the antenna elements of the antenna illustrating the dipoles with capacitively loaded stubs shorted to ground.

FIG. 3 is a diagram presenting a 3D view of one of the antenna elements 104 of the antenna 100 illustrating the dipoles with capacitively loaded stubs shorted to ground which produce the ultra wide band, dual band performance of the antenna radiator structure.

Figure 4A:
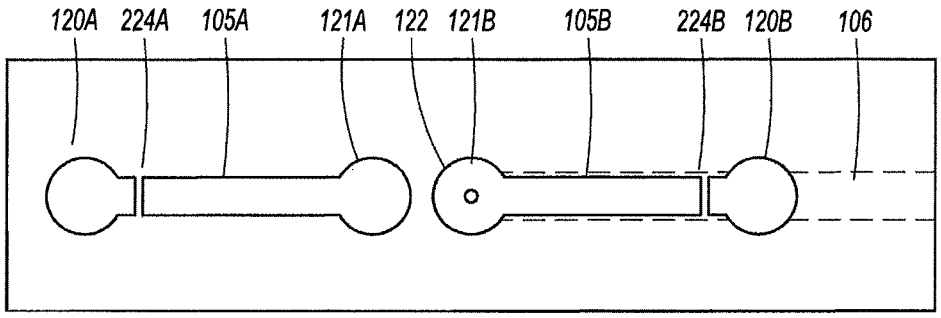
FIGS. 4A and 4B are diagrams illustrating top and bottom views, respectively, of the dipole antenna unit cell with dielectric superstrate, substrate, capacitively loaded stubs and, connecting vias and the feedline.
Figure 4B:
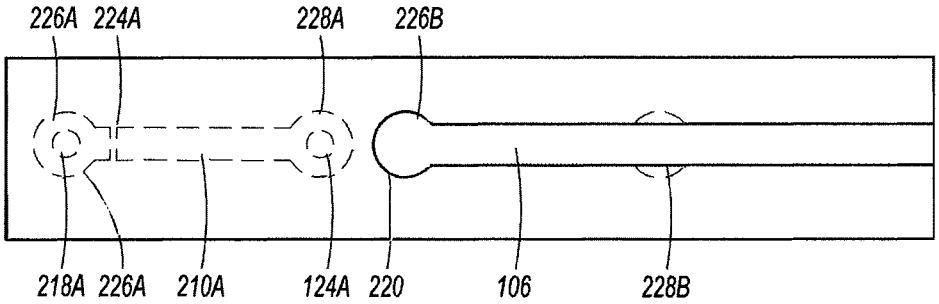

FIGS. 4A and 4B are diagrams illustrating top and bottom views, respectively, of the dipole antenna unit cell 104 with dielectric superstrate, substrate, capacitively loaded stubs 218A and 218B, connecting vias and the feedline 106.

The unit cell horizontal dimensions (on the top view of FIG. 4A) are chosen to meet the end-fire (maximum) scan angle (in one embodiment, 90 degrees from array broadside) requirement at the highest frequency band. The vertical distance from the radiating dipoles 104A and 104B to the horizontal ground plane 206 is chosen to re-direct backward radiation to the forward direction and, to provide an additional mechanism for impedance bandwidth tuning. The sizes of gaps 224A and 224B of the grounded stubs 218A and 218B, first and second dipole 104 shape/width and superstrate 110 electrical thickness provide other tuning opportunities to improve overall scan performance. In one embodiment, the length of the dipole is 73/1000 of an inch, or 73 mil, the capacitive gap is 2 mil and the height of the antenna elements above the ground plane 206 is 50 mil. The distance d between dipoles is typically ¼ the wavelength of the highest frequency to be transmitted or received for end-fire condition, for reduced backlobe in end-fire conditions. For applications that do not involve end-fire, the distance d between dipoles is typically ½ the wavelength of the highest frequency.

The conductive antenna feeds or feedlines 106 may be connected to active electronics including low-noise and power amplifiers, time-delay or beam-steering devices and other signal-conditioning devices to form an active electronically-scanning antenna system. While the illustrated feeds are microstrip feeds, they may be stripline feeds or coaxial feeds as well.

The thicknesses of the circuit board dielectric layers 110, 112 and 114 are chosen so that the overall structure meets mechanical stress requirements. The thicknesses and dielectric constant(s) of the circuit board dielectrics 110, 112 and 114 are also chosen to meet manufacturability constraints. A thin non-metallic environmental coating or paint may be placed on top of the superstrate 110 with minor retuning.

Figure 5:
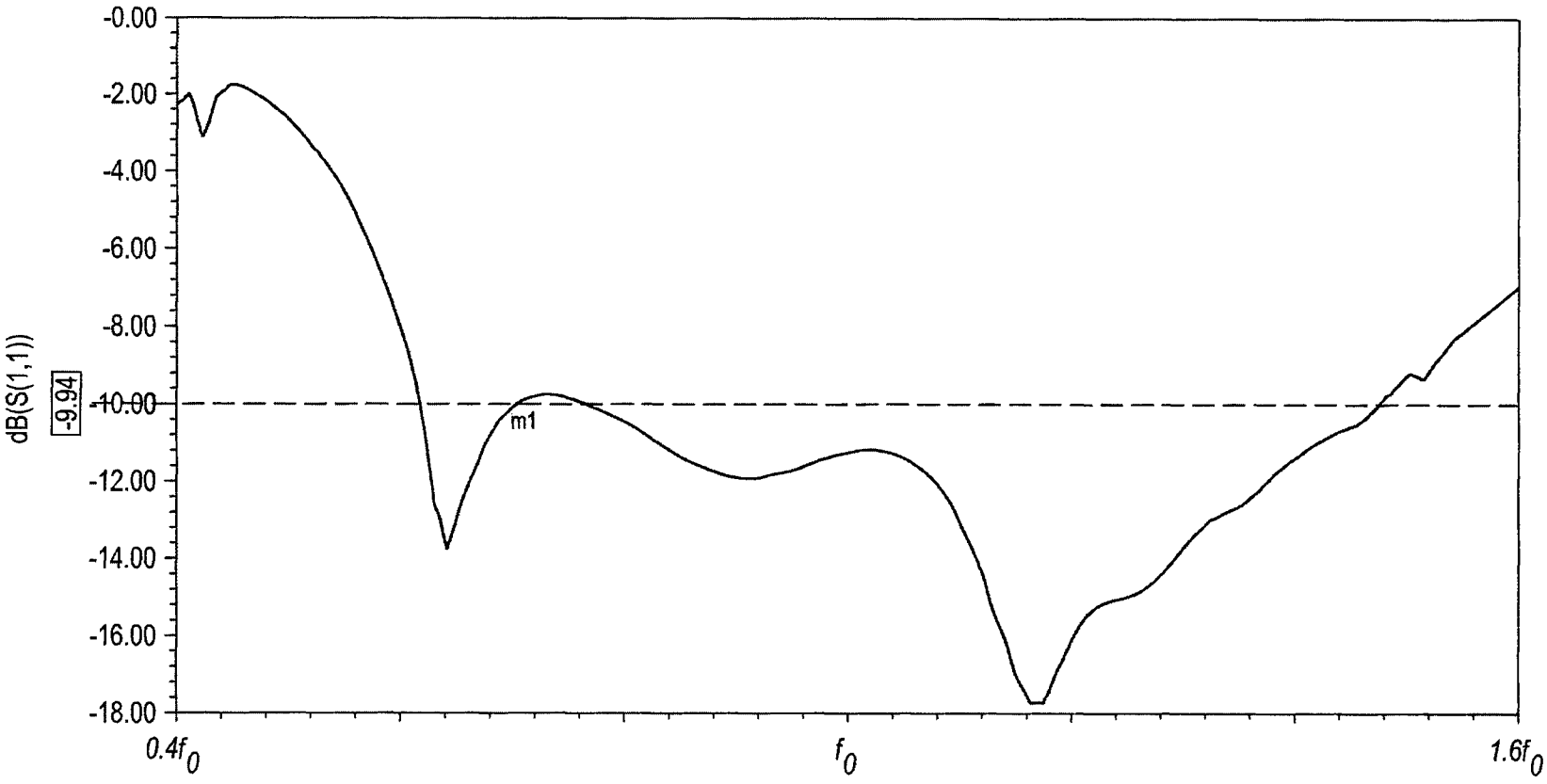
FIG. 5 is a diagram depicting a full-wave simulated return loss performance for the antenna array as depicted in FIGS. 1-4B at a scan angle of zero.

FIG. 5 is a diagram depicting a full-wave simulated return loss performance for the antenna array as depicted in FIGS. 1-4A at a scan angle of zero (boresight). Good impedance match (for interior or non-edge elements) is observed over 2:1 full bandwidth and 25% fractional sub-bandwidth. Similar performance is observed over wide scan angles.

Figure 6:
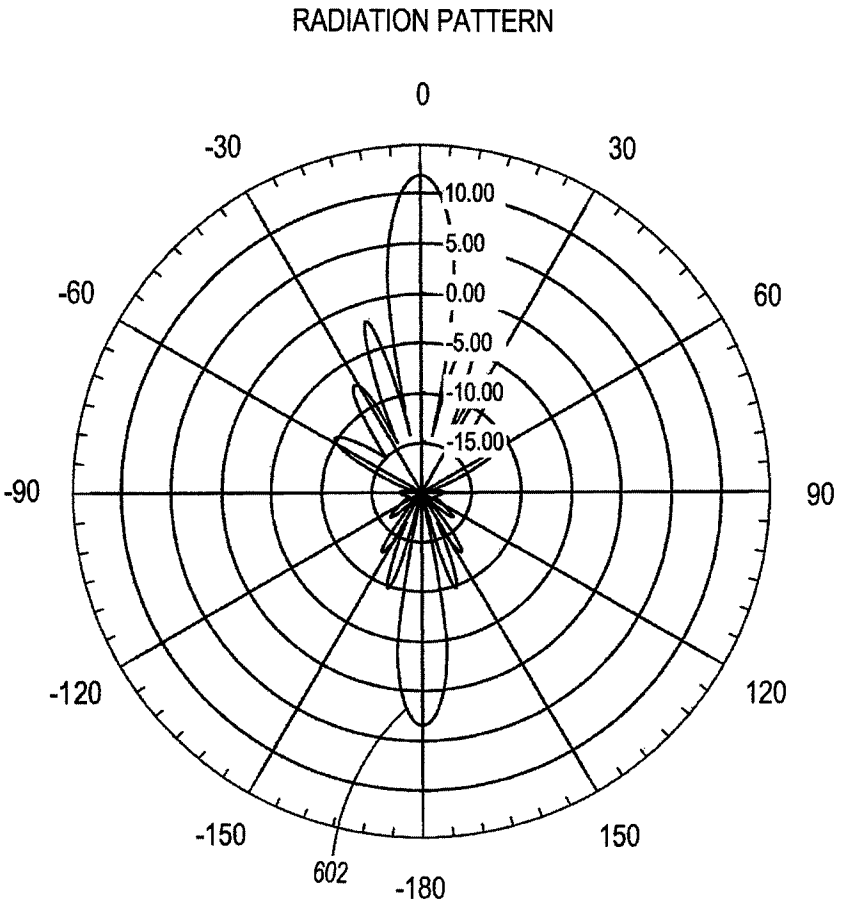
FIG. 6 shows full-wave simulated antenna array pattern performance for the array as depicted in FIGS. 1-4B at a boresight scan angle and a typical in-band frequency.

FIG. 6 shows full-wave simulated antenna array pattern performance for the array as depicted in FIGS. 1-4B at a boresight scan angle and a typical in-band frequency. Good antenna gain performance is achieved. The backlobe 602 is significant and primarily due to the relatively small electrical size of the finite ground plane 206.

Figure 7:
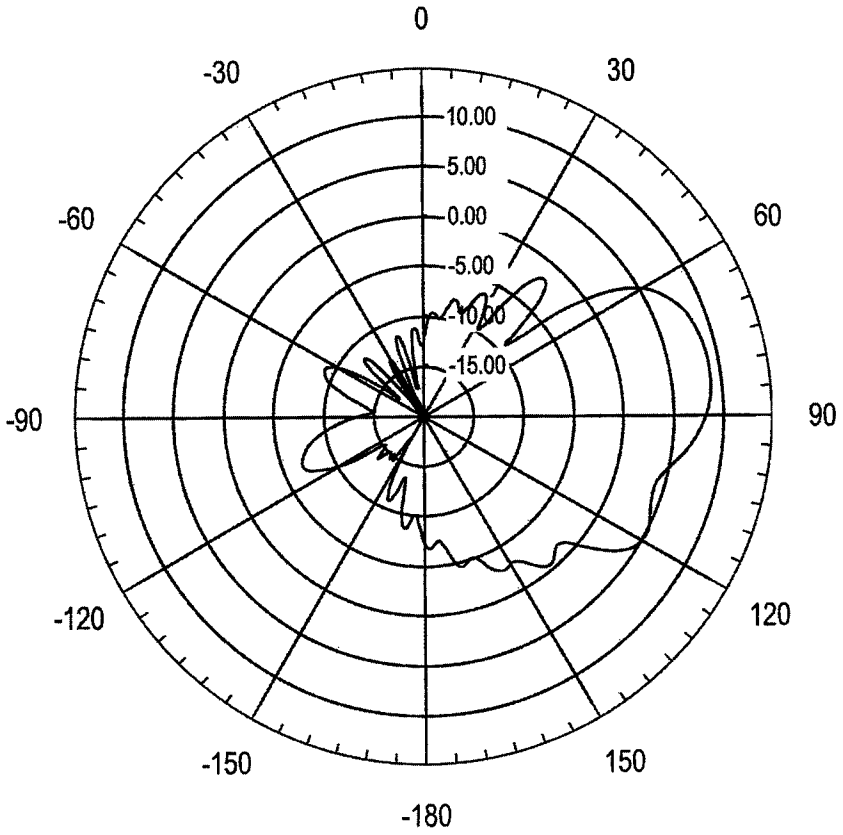
FIG. 7 is a diagram illustrating a full-wave simulated antenna array pattern at very wide scan of 80 degrees and typical in-band frequency.

FIG. 7 is a diagram illustrating a full-wave simulated antenna array pattern at very wide scan of 80 degrees and typical in-band frequency. Note that the antenna continues to exhibit good performance, even at wide scan angles.

Figure 8:
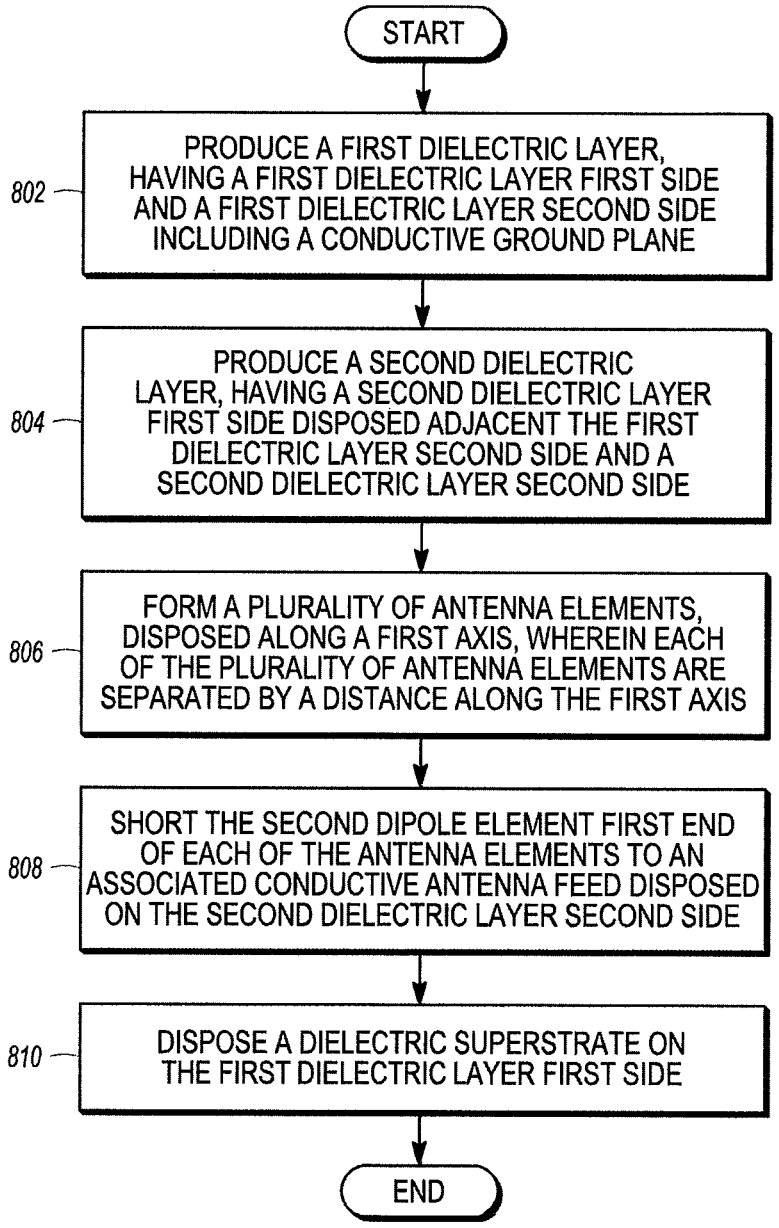
FIG. 8 is a diagram illustrating exemplary method steps that can be used to produce the above described antenna.

FIG. 8 is a diagram illustrating exemplary method steps that can be used to produce the above described antenna 100. In block 802, a first dielectric layer 112 is produced, where the first dielectric layer 112 includes a first dielectric layer first side and a first dielectric layer second side that includes a conductive ground plane 206. In block 804 a second dielectric layer is produced. The second dielectric layer 114 includes a second dielectric layer second side (e.g. the top of second dielectric layer 114) disposed adjacent the first dielectric layer second side and a second dielectric layer second side (e.g. the bottom of second dielectric layer 114).

A plurality of antenna elements 104 are formed, as described in block 806. The plurality of antenna elements 104 are disposed along a first axis 108, and each of the plurality of antenna elements 104 are separated from adjacent antenna elements by a distance d along the first axis 108. Each of the plurality of antenna elements 104 comprises a first dipole element 104A and a second dipole element 104B.

The first dipole element 104A is formed on the first dielectric layer first side along a second axis perpendicular to the first axis 108 and in the plane of the antenna 100, and the first dipole element 104A has a first dipole element first end 121A and a first dipole element second end 120A having a capacitively loaded first stub 124A. Similarly, the second dipole element 104B is formed on the first dielectric layer first side along the second axis and colinear with the first dipole 104A. The second dipole element 104B has a second dipole element first end 121B proximate the first dipole element first end 120A and a second dipole element second end 120B distal from the second dipole element first end 121B having a capacitively loaded second stub 218B.

Turning to block 808, the second dipole element first end 121B of each of the antenna elements 104 is connected to an associated conductive antenna feed 106 disposed on the second dielectric layer second side. Finally, a dielectric superstrate 110 may be disposed on the first dielectric layer 110 first (top) side.

Conclusion

This concludes the description of the preferred embodiments of the present disclosure.

The foregoing description of the preferred embodiment has been presented for the purposes of illustration and description. It is not intended to be exhaustive or to limit the disclosure to the precise form disclosed. Many modifications and variations are possible in light of the above teaching. It is intended that the scope of rights be limited not by this detailed description, but rather by the claims appended hereto.

What is claimed is:

1. An antenna, comprising:

a first dielectric layer, having a first dielectric layer first side and a first dielectric layer second side including a conductive ground plane;

a second dielectric layer, having a second dielectric layer first side disposed adjacent the first dielectric layer second side and a second dielectric layer second side;

a plurality of antenna elements, disposed along a first axis, wherein each of the plurality of antenna elements are separated by a distance along the first axis, wherein each of the plurality of antenna elements comprises:

a first dipole element formed on the first dielectric layer first side along a second axis perpendicular to the first axis, the first dipole element having a first dipole element first end and a first dipole element second end having a capacitively loaded first stub;

a second dipole element formed on the first dielectric layer first side along the second axis and colinear with the first dipole, the second dipole element having a second dipole element first end proximate the first dipole element first end and a second dipole element second end distal from the first dipole element first end having a capacitively loaded second stub; and wherein each of the second dipole element first ends are connected to an associated conductive antenna feed disposed on the second dielectric layer second side;

the capacitive loaded first stub is formed by a first gap between the first dipole element first end and the first dipole element second end and the first dipole element second end shorted to the conductive ground plane; and the capacitive loaded second stub is formed by a second gap between the second dipole element first end and the second dipole element second end and the second dipole element second end shorted to the conductive ground plane.

2. The antenna of claim 1, wherein the second dipole element first end is connected to the associated conductive antenna feed disposed on the second dielectric layer second side through a non-conductive aperture in the conductive ground plane.

3. The antenna of claim 2, further comprising a dielectric superstrate disposed on the first dielectric layer first side.

4. The antenna of claim 3, wherein the dielectric superstrate is configured to be conformal with an outer surface of a vehicle.

5. The antenna of claim 2, wherein the plurality of antenna elements are separated by a distance substantially equal to a ¼ free space wavelength of a highest frequency transmitted or received by the antenna.

6. The antenna of claim 5, wherein a bandwidth of the antenna is selected according to:

a length of the first dipole element;

a length of the second dipole element;

a length of the first gap;

a length of the second gap; and a thickness of the second dielectric layer.

7. The antenna of claim 1, wherein the plurality of antenna elements are disposed in only one row along the first axis.

8. A method of producing an antenna, comprising:

producing a first dielectric layer, having a first dielectric layer first side and a first dielectric layer second side including a conductive ground plane;

producing a second dielectric layer, having a second dielectric layer first side disposed adjacent the first dielectric layer second side and a second dielectric layer second side;

forming a plurality of antenna elements, disposed along a first axis, wherein each of the plurality of antenna elements are separated by a distance along the first axis, wherein each of the plurality of antenna elements comprises:

a first dipole element formed on the first dielectric layer first side along a second axis perpendicular to the first axis, the first dipole element having a first dipole element first end and a first dipole element second end having a capacitively loaded first stub;

a second dipole element formed on the first dielectric layer first side along the second axis and colinear with the first dipole, the second dipole element having a second dipole element first end proximate the first dipole element first end and a second dipole element second end distal from the first dipole element first end having a capacitively loaded second stub; and shorting the second dipole element first end of each of the antenna elements to an associated conductive antenna feed disposed on the second dielectric layer second side;

wherein the capacitive loaded first stub is formed by a first gap between the first dipole element first end and the first dipole element second end and the first dipole element second end shorted to the conductive ground plane; and wherein the capacitive loaded second stub is formed by a second gap between the second dipole element first end and the second dipole element second end and the second dipole element second end shorted to the conductive ground plane.

9. The method of claim 8, wherein the second dipole element first end is connected to the associated conductive antenna feed disposed on the second dielectric layer second side through a non-conductive aperture in the conductive ground plane.

10. The method of claim 9, further comprising disposing a dielectric superstrate on the first dielectric layer first side.

11. The method of claim 10, wherein the dielectric superstrate is configured to be conformal with an outer surface of a vehicle.

12. The method of claim 9, wherein the plurality of antenna elements are separated by a distance substantially equal to ¼ free space wavelength of a highest frequency transmitted or received by the antenna.

13. The method of claim 12, wherein a bandwidth of the antenna is selected according to:

a length of the first dipole element;

a length of the second dipole element;

a length of the first gap;

a length of the second gap; and a thickness of the second dielectric layer.

14. The method of claim 8, wherein the plurality of antenna elements are disposed in only one row along the first axis.

15. An antenna, produced by performing steps comprising steps of:

producing a first dielectric layer, having a first dielectric layer first side and a first dielectric layer second side including a conductive ground plane;

producing a second dielectric layer, having a second dielectric layer first side disposed adjacent the first dielectric layer second side and a second dielectric layer second side;

forming a plurality of antenna elements, disposed along a first axis, wherein each of the plurality of antenna elements are separated by a distance along the first axis, wherein each of the plurality of antenna elements comprises:

a first dipole element formed on the first dielectric layer first side along a second axis perpendicular to the first axis, the first dipole element having a first dipole element first end and a first dipole element second end having a capacitively loaded first stub;

a second dipole element formed on the first dielectric layer first side along the second axis and colinear with the first dipole, the second dipole element having a second dipole element first end proximate the first dipole element first end and a second dipole element second end distal from the first dipole element first end having a capacitively loaded second stub; and shorting the second dipole element first end of each of the antenna elements to an associated conductive antenna feed disposed on the second dielectric layer second side;

wherein the capacitive loaded first stub is formed by a first gap between the first dipole element first end and the first dipole element second end and the first dipole element second end shorted to the conductive ground plane; and wherein the capacitive loaded second stub is formed by a second gap between the second dipole element first end and the second dipole element second end and the second dipole element second end shorted to the conductive ground plane.

16. The antenna of claim 15, wherein the second dipole element first end is shorted to the conductive antenna feed disposed on the second dielectric layer second side through a non-conductive aperture in the conductive ground plane.

17. The antenna of claim 16, further comprising a dielectric superstrate disposed on the first dielectric layer first side.

18. The antenna of claim 17, further comprising disposing a dielectric superstrate on the first dielectric layer first side.

19. The antenna of claim 18, wherein the dielectric superstrate is configured to be conformal with an outer surface of a vehicle.

20. The antenna of claim 19, wherein the plurality of antenna elements are separated by a distance substantially equal to a ¼ free space wavelength of a highest frequency transmitted or received by the antenna.

* * * * *